US005222604A

United States Patent [19]

Tiramani

[11] Patent Number: 5,222,604

[45] Date of Patent: Jun. 29, 1993

[54] ORGANIZER

[76] Inventor: Paolo Tiramani, 461 Taconic Rd., Greenwich, Conn. 06831

[21] Appl. No.: 876,035

[22] Filed: Apr. 30, 1992

[51] Int. Cl.[5] ..... B65D 25/28

[52] U.S. Cl. ..... 206/581; 16/110.5; 206/565; 220/760; 220/761

[58] Field of Search ..... 16/110 A, 110 R, 110.5 126; 206/362, 369, 214, 549, 564, 581; 220/91, 92, 94 R, 756, 760, 761

[56] References Cited

U.S. PATENT DOCUMENTS

| | | | |
|---|---|---|---|
| 2,427,004 | 9/1947 | Kampf | 16/126 |
| 3,124,266 | 3/1964 | Morgan | 220/318 |
| 3,248,002 | 4/1966 | Song | 220/94 R |
| 3,278,216 | 10/1966 | Hidding | 220/94 R |
| 3,464,586 | 9/1969 | Hitzeroth | 220/94 R |
| 4,071,939 | 2/1978 | Bock | 220/91 |
| 4,215,789 | 8/1980 | Pfeifer | 220/91 |
| 4,720,021 | 1/1988 | Byrns | 220/94 R |
| 4,895,231 | 1/1990 | Yamaguchi et al. | 16/126 |
| 5,035,321 | 7/1991 | Denton | 220/318 |

*Primary Examiner*—Jimmy G. Foster
*Attorney, Agent, or Firm*—Thomas L. Adams

[57] ABSTRACT

An organizer has a tray with a central stall. An invertable handle is mounted on the tray to swing about a handle axis between an exposed position and an inverted position. The tray has a detention device for holding the handle in the exposed position. An arched holder is pivotally mounted atop the tray to fold flat against it. This arched holder is mounted to straddle the handle.

28 Claims, 4 Drawing Sheets

ORGANIZER

BACKGROUND OF THE INVENTION

The present invention relates to organizers, and in particular, to organizers having a handle that swings between an exposed and a stored position.

An organizer is helpful for keeping numerous small objects together and readily accessible. For example, a complement of cosmetics can include numerous small items such as eyeliner pencils, lipsticks, compacts, various bottles, brushes, elastic bands, loops, etc. Much time can be wasted locating these various items when applying makeup.

An organizer can benefit from a handle, as well as a holder specially adapted for holding various small objects. Such a handle or holder should project outwardly, but such outward projection consumes much space when the product is being shipped.

Various types of trays have been made for holding reagents, dental tools, food, lipstick, etc. Some trays are molded with a shell-like structure to give the appearance but not the reality of a solid body, in order to conserve material. See for example U.S. Pat. No. 4,573,586.

Known trays include a handle that can be mounted in the center of the tray. In U.S. Pat. No. 2,553,880 a centrally mounted handle can be snapped out of a socket and stored inside the tray to conserve space during shipment. The handle, however, is loose during shipment, requires some assembly skill, and can be lost before assembly.

U.S. Pat. No. 4,904,031 shows an earring storage device having quarter and half panels that rotate about a common axis. Those panels have an arch over them, which never swings into a storage position. This storage device therefore does not fold flat and is not made compact for shipment.

A related design patent application (U.S. Ser. No. 07/774,263, filed Oct. 10, 1991) shows the appearance of an organizer by the same applicant, but does not reveal the structural and functional details disclosed and claimed herein.

See also U.S. Pat. Nos. 1,045,135; 1,484,613, 1,704,122; 2,107,023; 2,790,547; 4,610,348; and 4,849,177, as well as U.S. Design Patent Nos. 76,482; 142,366; and 183,165.

Accordingly, there is a need for an organizer in the form of a tray that can have a handle or a holder that enhances the use of the organizer, but which can be placed into a stored position to reduce the package bulk during shipment.

SUMMARY OF THE INVENTION

In accordance with the illustrative embodiments demonstrating features and advantages of the present invention, there is provided an organizer having a tray with a central stall. An invertable handle is mounted on the tray to swing about a handle axis between an exposed position and an inverted position. The tray has a detent means for holding the handle in the exposed position.

In a related embodiment of the same invention, an organizer also includes a tray with a central stall. A handle is mounted on top of the tray and is sized to be stored in the stall. An arched holder is pivotally mounted atop the tray to fold flat against it. This arched holder is mounted to straddle the handle.

By employing such equipment, an improved organizer is achieved. In a preferred embodiment, the organizer is a shell having pockets and dividing partitions to hold various items, such as cosmetics.

The preferred organizer has a D-shaped handle rotatably mounted in a central, handle slot. The straight leg of the D-shaped handle has a cylindrical rotor with notches. The cylindrical rotor is journalled in the slot to rotate between an upright, exposed position and an inverted position. Tabs projecting at the slot engage the notches on the cylindrical rotor to hold the handle in either the exposed or the inverted position. Thus, the handle can be shipped in the inverted, stored position and simply rotated up when in use.

In this preferred organizer, a daisy-shaped holder can stand in an upright position. Fingers or petals projecting from the daisy-shaped holder can hold various items such as elastic bands, rings, hair bands, etc. This preferred holder is rotatably mounted on bosses located at the ends of the handle slot. The holder itself can fold flat against the top of the organizer.

In the preferred embodiment, the shell has a skirt girded by a soft band to add bulk and vary the texture and color of the organizer.

BRIEF DESCRIPTION OF THE DRAWINGS

The above brief description as well as other objects, features and advantages of the present invention will be more fully appreciated by reference to the following detailed description of presently preferred, but nonetheless, illustrative embodiments in accordance with the present invention, when taken in conjunction with the accompanying drawings, wherein.

DETAILED DESCRIPTION OF THE PREFERRED EMBODIMENTS

Figure 1:
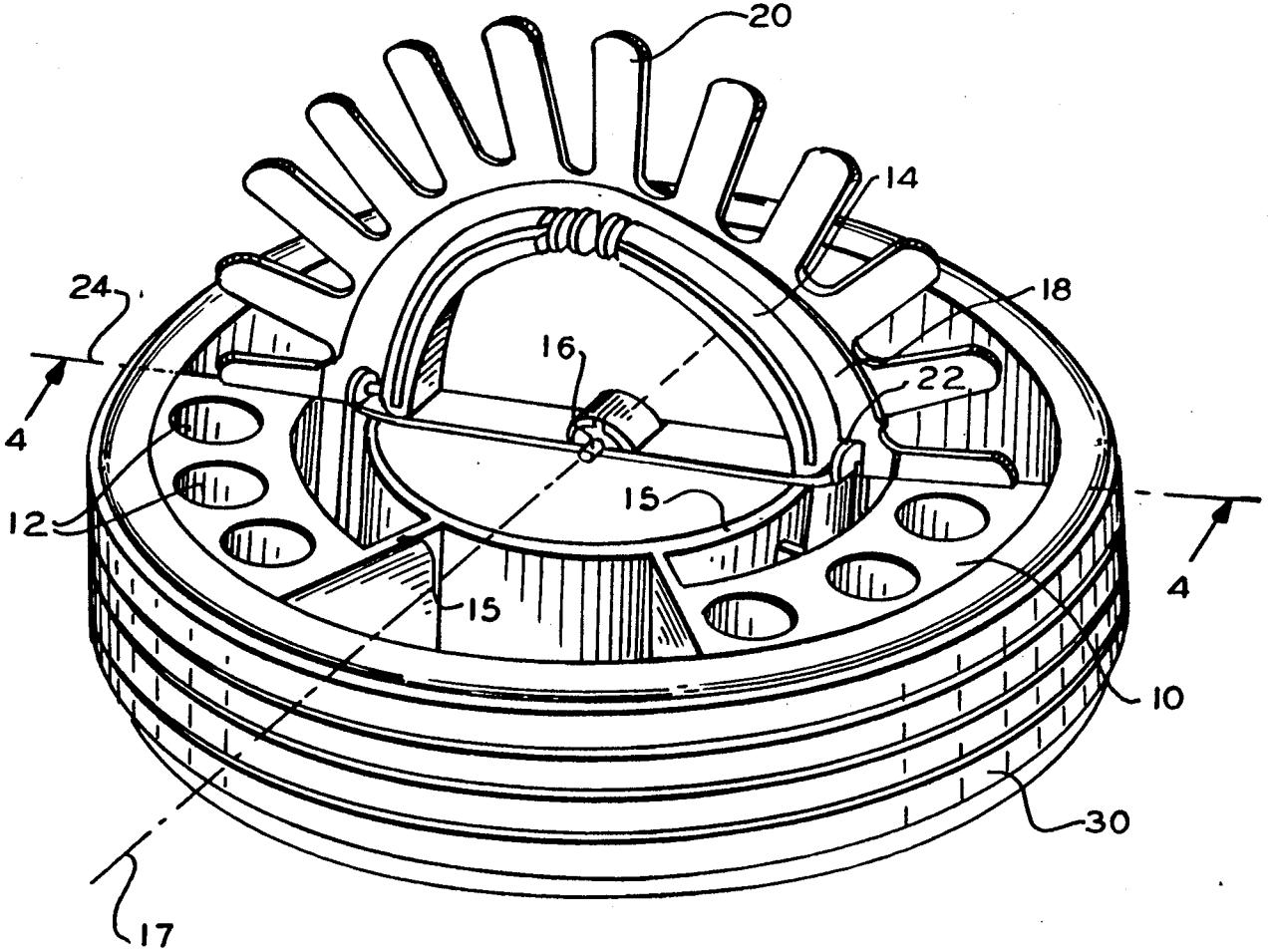
FIG. 1 is a perspective view of an organizer in accordance with the principles of the present invention.
Figure 2:
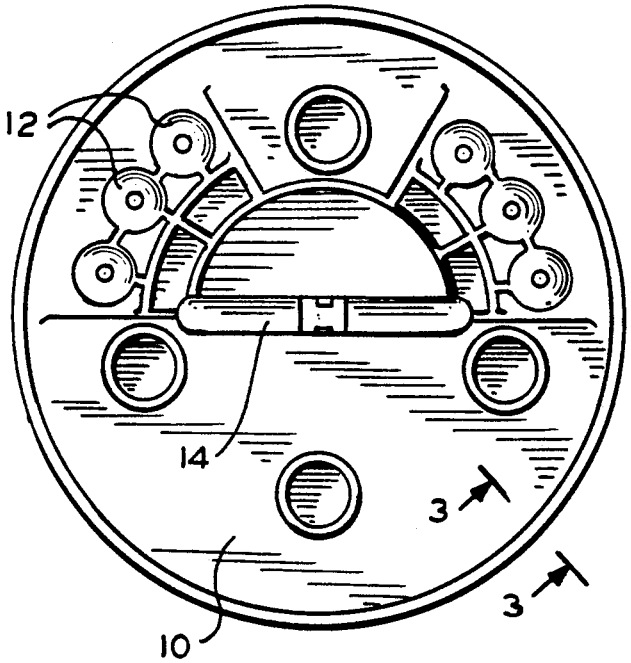
FIG. 2 is a bottom view of the organizer of FIG. 1.

Referring to FIGS. 1 and 2, an organizer is shown as a tray comprising a plastic, central shell 10, including a number of pockets 12. For example, cylindrical pockets are shown for holding cosmetics such as lipstick. The other pockets shown here have a frustro-cylindrical shape, although other shapes are possible. The tray includes dividing partitions 15 in various locations to segregate the pockets into separate compartments.

An invertable handle 14, shown as a D-shaped plastic member, has an arched portion over a finger opening. Handle 14 is rotatably mounted on trunion 16 to rotate about handle axis 17. As described further hereinafter, handle 14 rotates in a horizontal plane between an upright, exposed position to an inverted, stored position.

Figure 7:
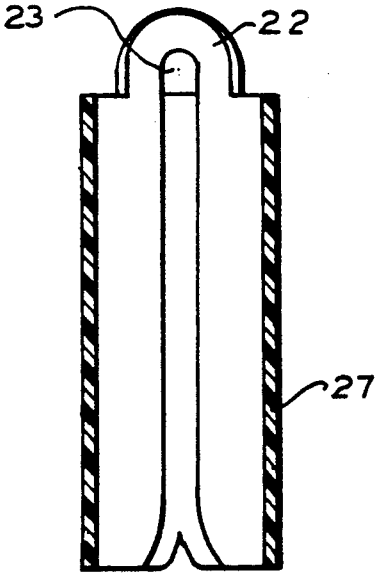
FIG. 7 is a cross-sectional view of the stall, taken along line 7—7 of FIG. 5.

Also rotatably mounted on the tray is a daisy-shaped holder 18 having twelve petals or fingers 20, although a different number can be employed instead. The fingers 20 are designed to hold annular objects such as elastic bands, rings, hair bands, etc. Holder 18 is designed to swing about holder axis 24. Holder 18 is journalled on cylindrically curved, upright bosses 22 that project upwardly from top of shell 10. FIG. 7 shows the inside of boss 22, revealing journal hole 23.

Figure 3:
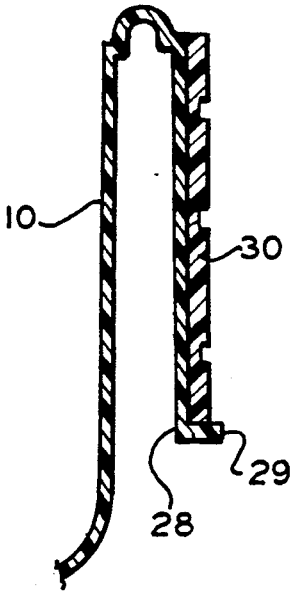
FIG. 3 is a cross-sectional view of the shell and skirt of the organizer, taken along line 3—3 of FIG. 2.

Referring to FIG. 3, the perimeter of shell 10 is shown having a dependent skirt 28 with an L-shaped cross section. The skirt 28 is girded by band 30. Band 30 can be a softer plastic that acts as a bumper and can have a different color or texture for an accent. Band 30 is installed simply by slipping it down around the skirt 28 until it rests on ledge 29 of skirt 28.

Figure 4:
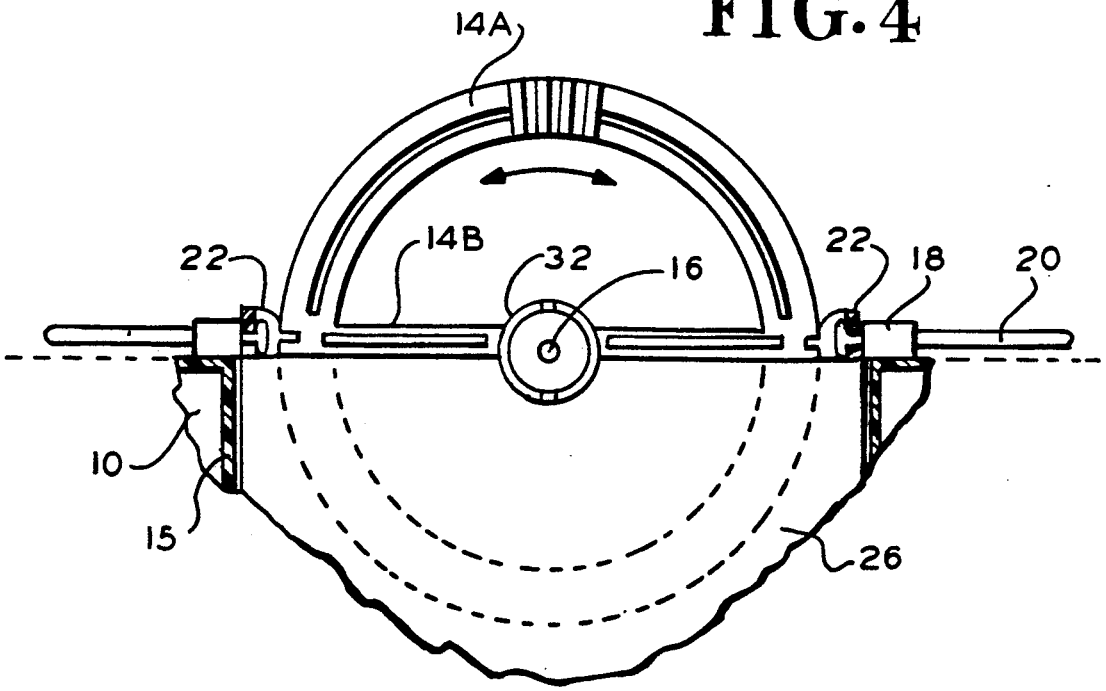
FIG. 4 is a detailed, partial, cross-sectional view taken along line 4—4 of FIG. 1.
Figure 5:
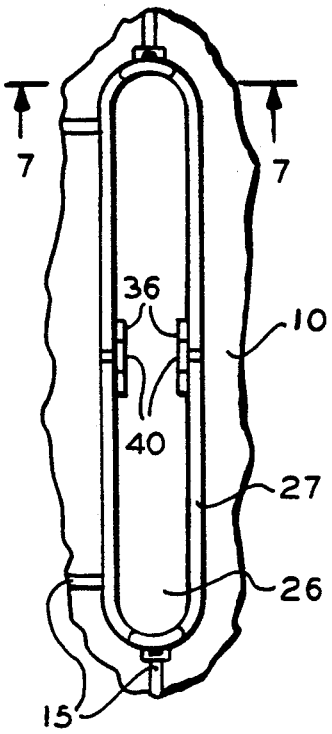
FIG. 5 is a detailed top view of the central stall and the organizer of FIG. 1, shown with the holder and handle removed.
Figure 6:
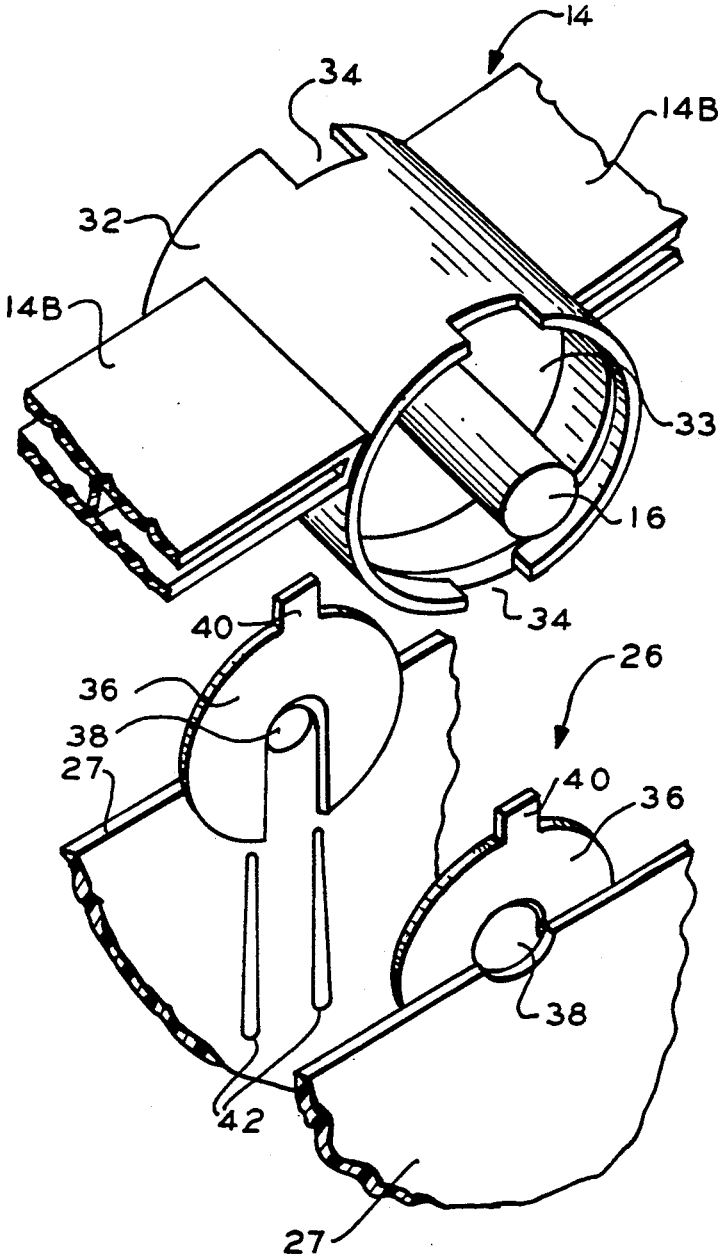
FIG. 6 is a detailed, exploded view of the rotating joint between the handle and stall of the organizer of FIG. 1.

Referring to FIGS. 4, 5, and 6, D-shaped handle 14 is shown with an arched portion 14A connecting to a straight portion 14B. Integrally molded in straight portion 14B is cylindrical rotor 32, shown in detail in FIG. 6. Rotor 32 is generally hollow except for a central transverse wall 33. Trunions 16 project perpendicularly in opposite directions from center wall 33. Four notches 34 are molded as indicated on the periphery of rotor 32.

Stall 26 is a slot-shaped opening whose upper portion is bordered by oval wall 27. Stall 26 is open from above and below. Stall 26 has a disk-like embossment 36 concentrically embracing a pair of opposing holes 38. Disks 36 have an upright tab 40 operating as a detent means. As described hereinafter, this detent means can hold handle 14 in either an exposed or in a stored, inverted position.

Disks 36 also have lower radial slots, giving the disks a C-shape. Aligned with the radial slot of disk 36 are a pair of rails 42 embossed into the inside surface of wall 27. Rails 42 and the slots in disks 36 form a track for guiding trunions 36 into holes 38 during assembly. Handle 14 is installed by thrusting it up into stall 26 from below, so that disks 36 as well as rails 42 guide trunions 16 into holes 18.

Figure 8:
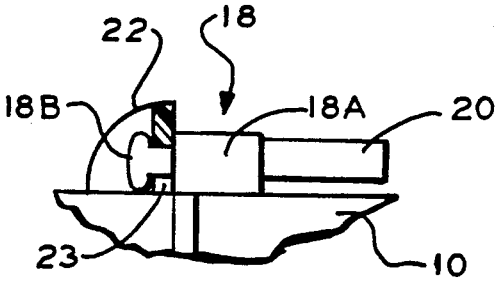
FIG. 8 is a detailed view of the rotating joint between the holder and boss of FIG. 4.
Figure 9:
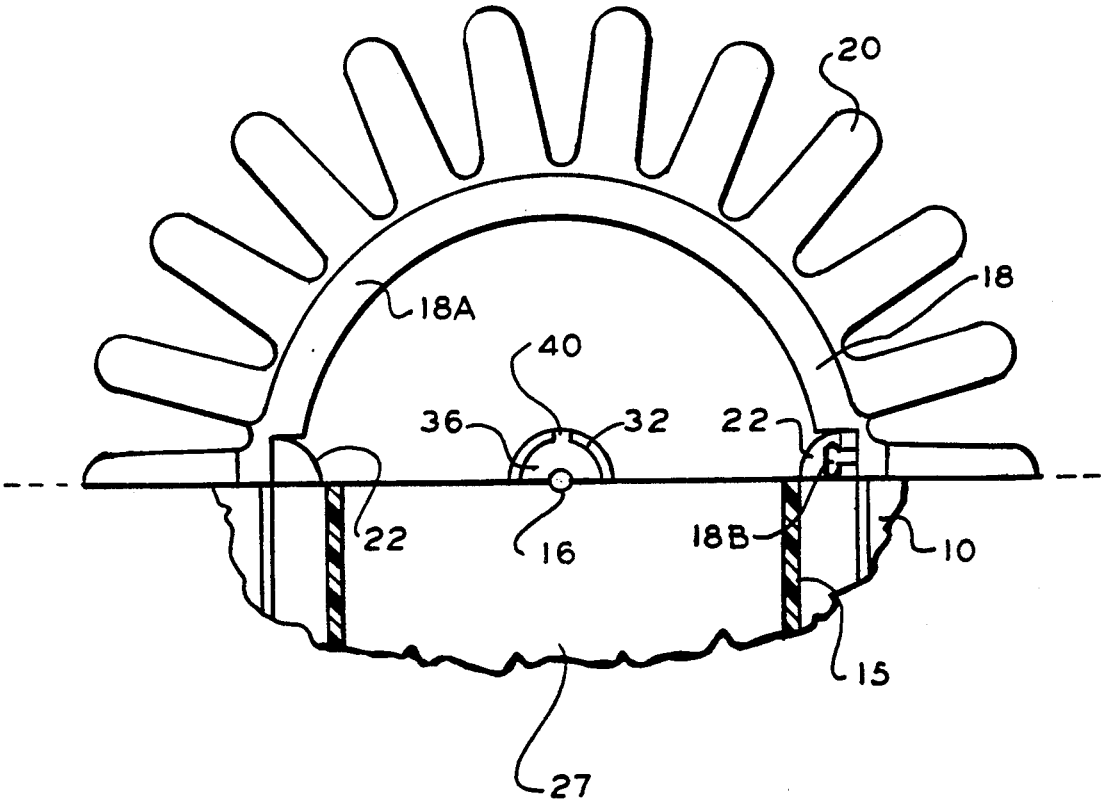
FIG. 9 is a modified view of the structure of FIG. 4 (the left boss is not sectioned in this view), but with the holder swung into an upright position and the handle swung into the inverted, stored position.

Referring to FIGS. 4, 5, 7, 8 and 9, holder 18 is shown as a daisy-shaped arch, with radially projecting petals or fingers 20. Holder 18 has a trunion 18B (FIG. 8) mounted in hole in previously mentioned boss 22. The holder is removed in this view for simplicity and clarity. The end of trunion 18B is peened into the shape shown with an appropriate heating tool. Holder 18 is generally flat but has a thickened, arching, rectangular base 18A, having flat sides and a flat bottom. As shown in FIG. 8, a flat side of base 18A is folded against the top side of shell 10. Consequently, holder 18 will be held in a folded or stored position. Holder 18 can also be rotated into an upright position at which time the flat bottom of base 18A snaps into place as shown in FIG. 9 to keep holder 18 upright.

To facilitate an understanding of the principles associated with the foregoing apparatus, its operation will be briefly described. The tray can be fabricated by molding shell 10 in the form shown in FIG. 1. Thereafter band 30 can be slipped over skirt 28 (FIG. 3). Next handle 14 can be pressed upwardly through stall 26 guided by tracks 42 (FIG. 6) and the slots in disks 36, so that trunions 26 pop into holes 38. Holder 18 can be installed by inserting its trunion 18B into the holes 23 (FIG. 7) in boss 22. Trunions 18B can then be heated and peened as shown in FIG. 9.

Once assembled, the tray can be configured in a stored condition by rotating handle 14 from the position shown in FIG. 4 into the stored position indicated in phantom. When in the stored position, the handle is hidden as shown in FIG. 9. Holder 18 can be rotated from the upright position of FIG. 9 to the flat, folded position shown in FIG. 4. In doing so, the flat bottom of arched base 18A rotates away from the top of shell 10. When thus configured, the top of the organizer has essentially no significant projections.

The user can move the handle and holder into the upright position as follows: the handle can be rotated about trunion 16 until it reaches the upright position, at which point, tabs 40 (FIG. 6 and 9) snap into the notches 34 of rotor 32. Next, holder 18 can be rotated into an upright position, wherein the flat underside of arched base 18A rests against the top side of the shell 10, keeping holder 18 in an upright position.

The outside curve of handle 14 matches the inside curve of the holder 18, so they conform. This feature allows for an efficient and compact operation for handle 14 and holder 18.

The user can now place various objects, such as various cosmetic items in the pockets and compartments in shell 10. Lipsticks can be conveniently placed in the cylindrical pockets in shell 10. Furthermore, the user can place hair bands, elastic bands, rings, and other objects on the fingers 20 of holder 18.

The organizer can be carried by grasping handle 14. In some instances, holder 18 can be folded down to take the items stored on the holder out of the way of handle 14. This makes the organizer more compact, to make the handle 14 more accessible, and carrying easier.

It is to be appreciated that various modifications may be implemented with respect to the above described preferred embodiments. For example the size, arrangement, and shape of the various pockets, compartments and dividing partitions of the tray can be altered depending upon the objects to be stored. Also, while the tray is shown as having a circular plan, in other embodiments, the plan can be oval, rectangular, polygonal, etc. In other embodiments, the handle need not be D-shaped but can be rectangular, polygonal, etc. While a handle detainer is shown here as a tab and notch, in other embodiments, different detainers can be used, such as ball and sockets, friction fitting, splines, etc. Similar detention means can be used to keep the holder in desired positions. In some embodiments the holder may not have fingers or petals as illustrated, but may include hooks, fasteners, or a more simplified structure by which objects can be attached or hung. Also, the organizer can be made of various types of plastics, metals or other materials, depending upon the desired strength, weight, reliability, rigidity, etc.

Obviously, many modifications and variations of the present invention are possible in light of the above teachings. It is therefore to be understood that within the scope of the appended claims, the invention may be practiced otherwise than as specifically described.

I claim:

1. An organizer comprising:

a tray having a central stall, said stall having a slot-shaped opening; and an invertable handle mounted on said tray to swing about a handle axis between an exposed position and an inverted position, said handle being pivotally mounted in said slot-shaped opening, said tray having:

a detent means for holding said handle in said exposed position.

2. An organizer according to claim 1 wherein said handle is pivotally mounted at said stall to occupy said stall when said handle is in said inverted position.

3. An organizer according to claim 2 wherein said handle has an arched portion defining a finger opening transverse to said handle axis.

4. An organizer according to claim 3 wherein said handle has in a plane perpendicular to said handle axis a D-shape.

5. An organizer according to claim 2 wherein said handle includes:

a cylindrical rotor having a notch and being mounted on said tray coaxially with said handle axis, said tray having a tab sized and positioned to releasably engage said notch and detain said handle in said exposed position.

6. An organizer according to claim 1 wherein said handle includes:

a cylindrical rotor having a notch and being mounted on said tray coaxially with said handle axis, said tray having a tab sized and positioned to releasably engage said notch and detain said handle in said exposed position.

7. An organizer according to claim 6 wherein said stall has a slot-shaped opening having a spaced pair of opposing holes, said handle being pivotally mounted in said opposing holes in said slot-shaped opening, said stall having a track below at least one of said opposing holes for guiding said handle to said holes during installation of said handle.

8. An organizer according to claim 7 wherein said stall is open from above and below.

9. An organizer according to claim 1 wherein said tray comprises:

a central shell of substantially uniform thickness having at least one pocket formed therein, said shell having mounted atop it at least one upright position.

10. An organizer according to claim 9 wherein said tray comprises:

a skirt depending from said central shell.

11. An organizer according to claim 10 wherein said skirt has an L-shaped cross section, said tray further comprising:

a band girding said skirt.

12. An organizer according to claim 9 wherein said tray is sized to hold facial cosmetics.

13. An organizer according to claim 12 wherein said pocket is sized to hold a lipstick.

14. An organizer according to claim 1 further comprising:

an arched holder pivotally mounted atop said tray to fold flat against it.

15. An organizer according to claim 14 wherein said arched holder is mounted to straddle said handle.

16. An organizer according to claim 15 wherein said arched holder is mounted to pivot about a holder axis that is transverse to said handle axis, said holder having means to detain said holder in an upright position.

17. An organizer according to claim 16 wherein said arched holder is sized to swing over said handle when in its exposed position.

18. An organizer according to claim 17 wherein said arched holder has a spaced plurality of peripheral fingers that project radially outward.

19. An organizer according to claim 16 wherein said arched holder is sized to swing above said handle when in its exposed position to crown said handle conformally.

20. An organizer according to claim 16 wherein said stall has a slot-shaped opening, said handle being pivotally mounted in said slot-shaped opening, said tray comprising:

a spaced pair of bosses mounted at opposite ends of said slot-shaped opening, said holder being journalled in said bosses.

21. An organizer according to claim 14 wherein said tray comprises:

a central shall of substantially uniform thickness having at least one pocket formed therein, said shell having mounted atop it at least one upright partition.

22. An organizer comprising:

a tray having a central stall;

a handle mounted atop said tray and sized to be stored in said stall; and an arched holder pivotally mounted atop said tray to fold flat against it, said arched holder being mounted to straddle said handle.

23. An organizer according to claim 22 wherein said handle has an exposed and a stored position, said arched holder being sized to swing over said handle when in its exposed position.

24. An organizer according to claim 23 wherein said arched holder has a spaced plurality of peripheral fingers that project radially outward.

25. An organizer according to claim 24 wherein said arched holder is sized to swing above said handle to crown said handle conformally.

26. A cosmetic organizer comprising:

a tray having:

(a) a central shell of substantially uniform thickness having mounted atop it at least one upright partition, said shell being sized to hold cosmetics and having at least one pocket formed therein to hold a lipstick, (b) a skirt depending from said central shell, said skirt having an L-shaped cross section, (c) a band girding said skirt, and (d) a central stall having a slot-shaped opening with a spaced pair of opposing holes, said slot-shaped opening being open from above and below;

an invertable handle having a notched cylindrical rotor pivotally mounted in said opposing holes in said slot-shaped opening to swing about a handle axis from an inverted position inside said stall to an exposed position, said handle having a D-shaped portion defining a finger opening transverse to said handle axis; and an arched holder mounted atop said tray to straddle said handle and to pivot about a holder axis that is transverse to said handle axis and fold flat against said shell, said arched holder being sized to swing over said handle when in its exposed position and crown said handle conformally, said arched holder having a spaced plurality of peripheral fingers that project radially outward, said central shell having:

a tab sized and positioned to releasably engage said notched rotor of said handle and detain said handle in said exposed position, said stall having:

a track below at least one of said opposing holes of said slot-shaped opening for guiding said handle to said holes during installation of said handle.

27. An organizer comprising:

a tray having a central stall; and an invertable handle mounted on said tray to swing about a handle axis between an exposed position and an inverted position, said handle being pivotally mounted at said stall to occupy said stall when said handle is in said inverted position, said handle having an arched portion defining a finger opening transverse to said handle axis, said handle having in a plane perpendicular to said handle axis a D-shape, said tray having:

a detent means for holding said handle in said exposed position.

28. An organizer comprising:

a tray having a central stall; and an invertable handle mounted on said tray to swing about a handle axis between an exposed position and an inverted position, said tray having:

a detent means for holding said handle in said exposed position; and a central shell of substantially uniform thickness having at least one pocket formed therein, said shell having mounted atop it at least one upright partition.

* * * * *